US011262153B1

(12) United States Patent
McNeil

(10) Patent No.: US 11,262,153 B1
(45) Date of Patent: Mar. 1, 2022

(54) ARCHERY BOW CAM ANCHOR

(71) Applicant: MSCKI, LLC, Windom, MN (US)

(72) Inventor: David McNeil, Grant, MI (US)

(73) Assignee: MSCKI, LLC, Windom, MN (US)

( * ) Notice: Subject to any disclaimer, the term of this patent is extended or adjusted under 35 U.S.C. 154(b) by 0 days.

(21) Appl. No.: 17/215,818

(22) Filed: Mar. 29, 2021

(51) Int. Cl.
*F41B 5/10* (2006.01)
*F41B 5/12* (2006.01)

(52) U.S. Cl.
CPC ..... *F41B 5/123* (2013.01); *F41B 5/105* (2013.01)

(58) Field of Classification Search
CPC ..... F41B 5/10; F41B 5/105; F41B 5/123
See application file for complete search history.

(56) References Cited

U.S. PATENT DOCUMENTS 4,838,236 A * 6/1989 Kudlacek ..... F41B 5/10 124/25.6
5,791,322 A * 8/1998 McPherson ..... F41B 5/10 124/25.6
5,890,480 A * 4/1999 McPherson ..... F41B 5/105 124/25.6
7,938,109 B1 * 5/2011 Larson ..... F41B 5/10 124/25.6
8,544,456 B2 * 10/2013 Grace ..... F41B 5/10 124/25.6
9,494,379 B2 * 11/2016 Yehle ..... F41B 5/066

* cited by examiner

*Primary Examiner* — John A Ricci
(74) *Attorney, Agent, or Firm* — Warner Norcross + Judd LLP

(57) ABSTRACT

An archery bow is provided including limbs and at least one power cable disposed in a track of a cam rotatably mounted to a limb. The power cable is anchored to the cams with a fastener having a shaft registered in a hole defined by a landing surface of the cam so that a power cable is trapped in a cable capture void between a head of the fastener and the landing surface. The fastener can include a radius between a fastener axis and an outer edge of the head. A separation distance can be defined between the head and the track, with a ratio of the separation distance to the radius being less than 1:1. The separation distance can be less than a diameter of the power cable. A related method of use is provided.

22 Claims, 6 Drawing Sheets

ARCHERY BOW CAM ANCHOR

BACKGROUND OF THE INVENTION

The present invention relates to archery products, and more particularly to an anchor for a cable or string on an archery bow cam.

Conventional compound and crossbow archery bows include a bowstring and a set of power cables that transfer energy from the limbs and certain cams, eccentrics or pulleys (which are all referred to generally as "cams" herein) of the bow to the bowstring, and thus to an arrow or bolt shot from the bow. The cables and bowstring typically are strung from a cam on one limb to a cam on another limb. The power cables are guided by a cable guide or otherwise located so as not to interfere with movement of the bowstring or the travel of an arrow or bolt with the bowstring. When the bow is drawn, the power cables work with the cams to load the limbs of the bow, which store energy therein. In most cases, the function of the cams is to provide a mechanical advantage so that energy imparted to the arrow or bolt from the limbs is a multiple of that required of an archer to draw or cock the bow.

A bowstring and the power cables typically each include loops at the ends thereof. These loops are sized to be placed over anchors that are machined or milled into a respective cam of the archery bow to provide a suitable point of attachment to the cam. An issue with many conventional anchors is that to produce an anchor on a cam, the cam must be precisely machined out of a larger piece of material. This requires a milling head of a mill to engage the cam with surgical precision. The milling head, however, has a particular dimension, so if the anchor is to be placed at a particular location on a cam, and there is another feature of the cam adjacent or overlapping that location, the milling head can only travel so close to that feature without engaging and altering. Thus, the location of the anchor is limited by the size of the milling head on the mill. This can be problematic where cam efficiency dictates that the anchor be extremely close to another feature, such as a particular cable groove. Further, where a loop of a string or cable is placed over a machined anchor on a cam, sometimes, the diameter of the string or cable can bulge above or beyond the anchor. In turn, this can raise the profile of the string of cable to one that is actually greater than the height of the anchor. As a result, the overextending string or cable can interfere with movement of another portion of the string or cable.

Accordingly, there remains room for improvement in connection with anchors that properly secure a bowstring and/or power cable to a cam in a cam system of an archery bow.

SUMMARY OF THE INVENTION

An archery bow is provided including limbs and a power cable disposed in a track of a cam rotatably mounted to a limb. The power cable is anchored to the cams with a fastener having a shaft registered in a hole defined by the cam so that a power cable is disposed in a cable capture void between a head of the fastener and a landing surface of the cam.

In one embodiment, the fastener can include a radius between a fastener axis and an outer edge of the head. A separation distance can be defined between the head and the track, with a ratio of the separation distance to the radius being less than 1:1.

In another embodiment, the power cable can include a cable diameter. The separation distance can be less than the cable diameter. In this configuration, the cable cannot be removed from the fastener and/or cam without removing the fastener from the cam.

In still another embodiment, the power cable can extend away from the fastener and can contact a power cable track at a tangent location distal from the fastener. The tangent location can be disposed a tangent distance from a fastener axis. The tangent distance can be greater than the separation distance.

In yet another embodiment, the fastener can include a head and a shaft. The head can include an outer surface, a drive feature and a frustoconical portion extending from the planar outer surface to the shaft. The shaft can be installed in the hole in the cam so that the frustoconical portion extends away from the landing surface and so that the cable capture void is formed between the outer surface of the head or fastener and the landing surface.

In even another embodiment, the power cable can include a loop at an end. The loop can define a loop maximum dimension at an interior of the loop. The head can include a head diameter at the outer surface. The loop maximum dimension can be less than the first head diameter. The loop cannot be removed from the fastener or the cam without removing the fastener shaft from the hole in the cam.

In still a further embodiment, the power cable track can be a helical track having an upper cable track. Due to a low profile of the fastener and its head, the power cable can move over and clear the head when the archery bow is drawn.

In another, further embodiment, a method is provided. The method can include: providing a riser joined with a first limb and a second limb; placing a shaft of a fastener through a loop of a power cable so that the loop is adjacent a head of the fastener; installing the shaft of the fastener into a hole defined by a landing surface of a cam including a power cable track so that the power cable is trapped in a cable capture void between the head and the landing surface; and placing an elongated portion of the power cable in the power cable track.

In yet a further embodiment, the method can include establishing a separation distance between the head and the power cable track. The fastener can include a radius between a fastener axis and an outer edge of the head. The separation distance and the radius can be defined in a ratio of the separation distance to the radius, the ratio being less than 1:1.

The archery bow of the current embodiments provides benefits that were not previously achievable. Where the archery bow includes the fastener to anchor the power cable to the cam, the power cable can be attached to the cam extremely close to the power cable track. This, in turn can allow the power cable track to be designed as tight to the axle or otherwise without concern of placement of the anchor that secures the end of the power cable. The outer edge of the head can be placed a miniscule separation distance from the power cable track, which can further secure the power cable to the cam. The head of the screw also can serve as a part of the anchor to ensure the connection between the fastener and the end of the power cable remains secure. Where the power cable track is a helical track, with an upper track portion, a low profile of the fastener and its head can still allow the power cable to clear the fastener when the cam rotates as the archery bow is drawn.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
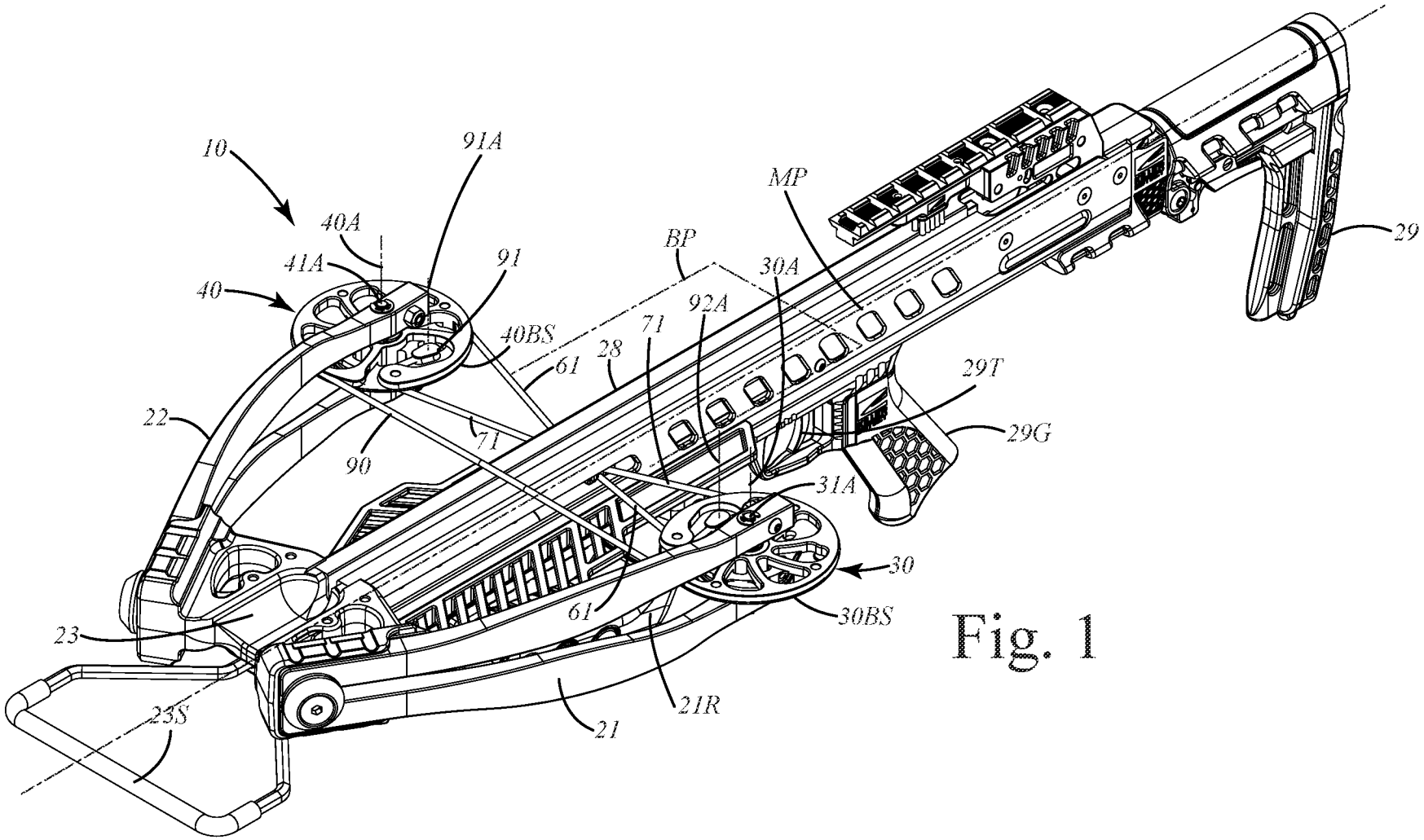
FIG. 1 is a perspective view of an archery bow in the form of a crossbow of the current embodiment.

An archery bow in the form of a crossbow in accordance with a current embodiment is illustrated in FIG. 1 and generally designated 10. The crossbow can include a cam and cable system including a first cam 30 and a second cam 40 mounted on a respective first limb 21 and second limb 22, which are joined with a riser 23. A bowstring 90 can engage the first cam 30 and the second cam 40 and can be configured to move in a bowstring plane BP. A first power cable 61 and a second power cable 71 can be strung between and can engage respective take up and let out tracks of each of the respective first cam 30 and second cam 40. A fastener anchor 50 can secure the respective power cables to the cams, with the fastener anchor being able to be placed extremely close to the cable tracks.

Although the current embodiment is described in connection with a crossbow, the cams, bowstring, cables and other features are suited for use with complex cam systems, as well as more simple pulley systems, for example, in single cam systems in some applications. The riser, cam assembly, bowstrings, cables and other features also can be used in other dual cam, cam and a half and single cam systems as well. Further, the embodiments herein are well suited for compound archery bows, dual cam bows, cam and a half bows, crossbows and other archery systems including two or more cams. As used herein, a "cam" refers to a cam, a pulley, and/or an eccentric, whether a modular, removable part, or an integral part of a cam assembly, for use with an archery bow. However, when a cam is described as an "eccentric cam," this refers to a cam that rotates about an axis distal from a center of the body, for example, a geometric center, and this term excludes perfectly circular pulleys such as those used in single cam archery bows. As used herein, a "track" refers to a structural element that is adapted to guide or accommodate a portion of a bowstring or power cable within or adjacent the element, and can be in the form of a groove, a recess, a slot, a contour, pins or posts extending from or defined by a surface or element, which may or may not be in the form of a cam. When in the form of a groove, recess or contour, a track can be defined by a part of an element, for example, defined by a bowstring cam and/or a power cable cam, and can be of virtually any geometric cross section, for example, partially or fully semi-circular, rounded, triangular, rectangular, square, polygonal, or combinations of the foregoing. Further, when any distance from some element to a power cable track is noted herein, unless otherwise specified, that distance is taken to the outermost rim or edge of a section of the track, rather than the belly or deepest depth of the track.

As used herein, an "axis of rotation" refers to an axis about which a cam or journal can and/or does rotate. An axis of rotation can coincide with a center of a respective axle, pin or post about which a cam or element rotates. Although not described in detail, the cams herein can include modular elements that provide some level of adjustment of a performance characteristic of a bow, including but not limited to, a particular draw weight or draw force for the bow. The cams also can include draw stops and other components common to compound bow cams depending on the application.

Figure 2:
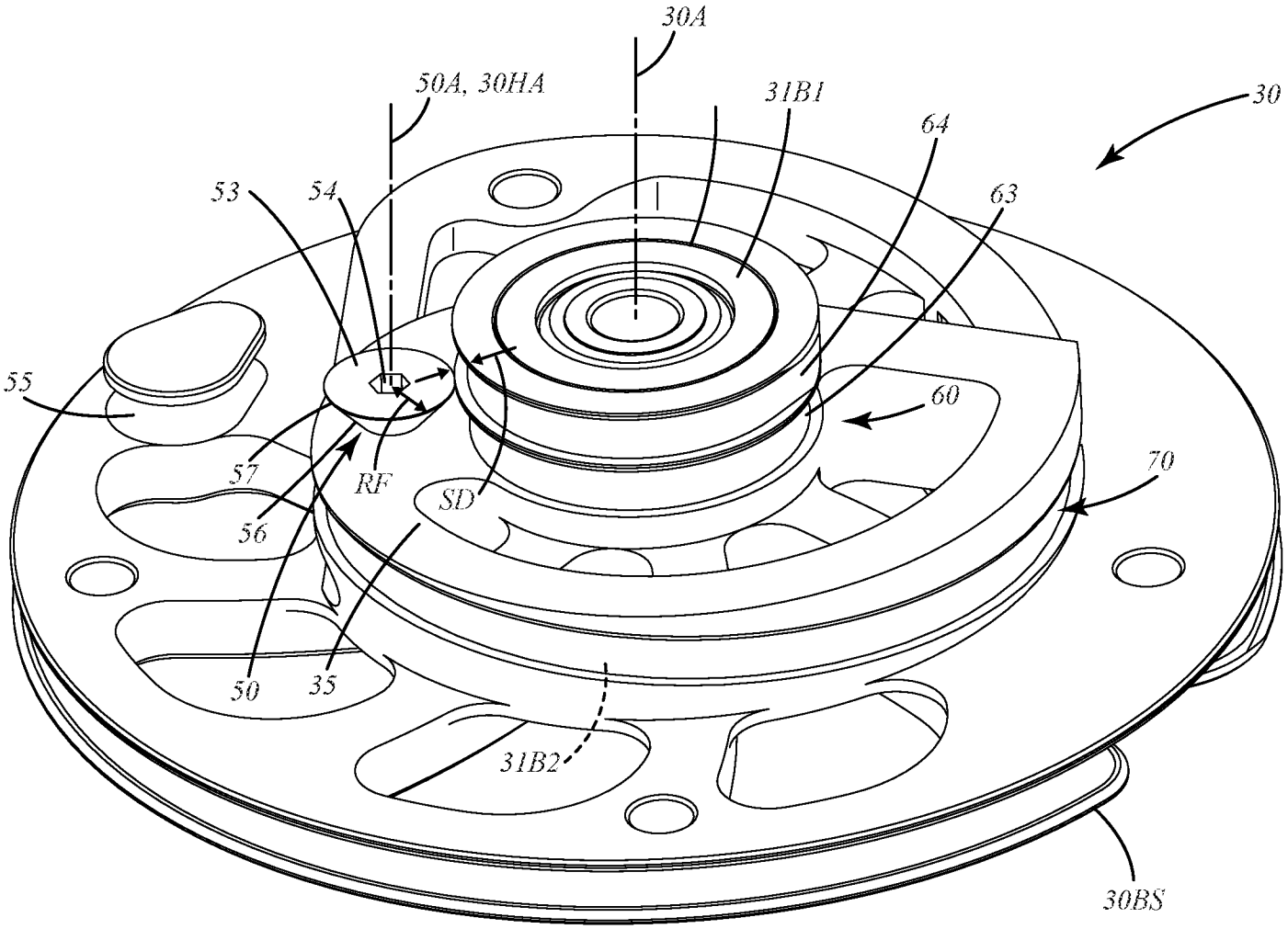
FIG. 2 is a perspective view of a cam of the crossbow with a fastener anchor installed adjacent a power cable track.

Turning with particular reference to FIGS. 1 and 2, the crossbow 10 can include first 30 and second 40 cams mounted to respective first limb 21 and second limb 22. The limbs can extend rearward from a riser 23. The riser 23 can be mounted to a forward end of a barrel 28 on which a bolt is configured to move. The riser and/or barrel can be joined with a stirrup 23S to aid in charging and cocking the crossbow. The barrel can extend rearward to a stock 29 which can be fixed or adjustable. A pistol grip 29G can extend outwardly from the barrel or other portion of the crossbow 10. A trigger 29T can be in communication with a trigger mechanism, which is configured to hold and selectively release the bowstring 90 upon actuation by a user. Although not shown, the crossbow 10 can include a safety mechanism and an anti-dry fire mechanism, among other things.

The crossbow 10 can define a medial plane MP which is generally aligned with the center of the barrel 28 and stock 29. The first cam 30 can be rotatably mounted to the first limb 21 via an axle 31A, and can be disposed on a first side of the medial plane MP. The second cam 40 can be rotatably mounted to the second limb 22 via an axle 41A, and can be disposed on a second, opposing side of the medial plane MP opposite the first limb 21.

As shown in FIGS. 1 and 2, each limb can be split or quad limb design having two substantially parallel portions separated from one another along a substantial portion of the length of the limb. Of course, other limb configurations can be selected, such as a solid limb including the limb recess at the limb tip. As shown in FIG. 1, each limb, for example, the first limb 21, can include a limb recess 21R. The first cam 30 can be disposed in the limb recess 21R.

Optionally, the cams 30 and 40 can include bearings, even with the respective power cable tracks are constructed as helical power cable tracks, located between those power cable tracks and the axle. For example, as shown in FIG. 2, a first bearing 31B1 and a second bearing 31B2 can be pressed into or otherwise joined with the first cam 30 and disposed between the first axis 30A and the respective first power cable track 60/second power cable track 70 of the first cam 30. The second cam can include similar bearings located in similar locations between a second axle and the respective power cable tracks of the second cam 40.

As shown, the bearings can be in the form of ball bearing sets with an outer raceway and an inner raceway. Of course, multiple other types of bearing systems are contemplated to be used or included as bearings. For example, needle bearings, Teflon bearings, polymeric bushings, metal bushings, or other bushings, or bearings having elements that move relative to one another, can be substituted in place of the ball bearings as illustrated. As shown, the inner raceway can be disposed immediately adjacent the axle 31A. The outer raceway can be located immediately adjacent a recess 31R into which the first bearing is placed. The outer raceway and bearing in general, can be press fit into the recess 31R. Further optionally, although not shown, one or more additional bearings can be disposed along the axle between it and the body of the cam 30. In some cases, the first and third bearings can be replaced with a single bearing, which can be more elongated and can extend a greater distance along the axle. Although not shown, the second cam 40 can include similarly situated and structured bearings that are located and positioned relative to the cam 40 and the limb 22 in a manner virtually identical to that of the bearings 31B1 and 31B2. The bearings in the cams can distribute forces well along the respective axles joining the cams to the limbs. The bearings can rotate efficiently and can withstand the forces and wear-and-tear due to rotation of the cams on the bearings relative to the respective axles.

As shown in FIGS. 1-6, the first cam 30 and second cam 40 can include respective bowstring tracks 30BS and 40BS. These bowstring tracks are configured to confine the bowstring 90 as it is drawn and released to fire a bolt from the crossbow 10. The bowstring 90 can be wound and unwound from the respective cams in these bowstring tracks. The bowstring can include respective first 91 and second 92 ends that are anchored to the respective cams 30 and 40, optionally at fixed anchors 91A and 92A that are milled or machined into the surfaces of the cams. As shown, the bowstring 90 can be a reverse draw bowstring, which is generally disposed forward of the cams 30 and 40 and generally forward of the axles 31A and 41A which mount the cams to the limbs. Of course, the cams, cables and bowstrings alternatively can be set up such that the bowstring 90 extending between the cams 30, 40 is rearward of the cams and the power cables, with the bowstring closer to the stock 29 of the crossbow 10 than the axles about which the cams rotate.

In addition to the bowstring tracks, each of the respective first and second cams can define one or more corresponding power cable tracks. For brevity, only the first 60 and second 70 power cable tracks associated with the first cam 30 will be described here, noting that the second cam 40 can be a mirror image of the first cam with corresponding cable tracks as described in connection with the first cam, and further can include virtually identical, but reversed features and structures.

Figure 3:
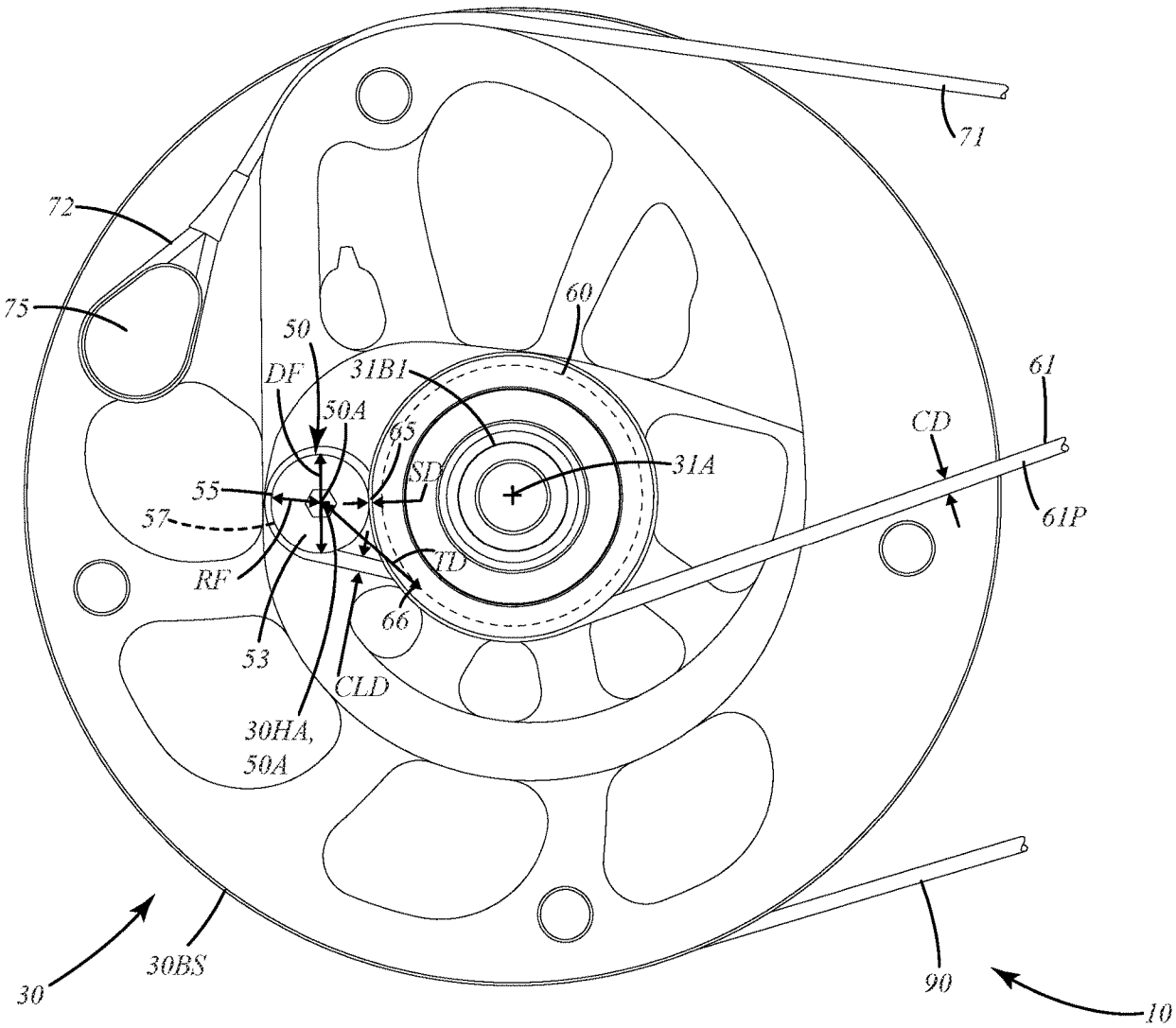
FIG. 3 is a top view of the cam with the fastener anchor.
Figure 4:
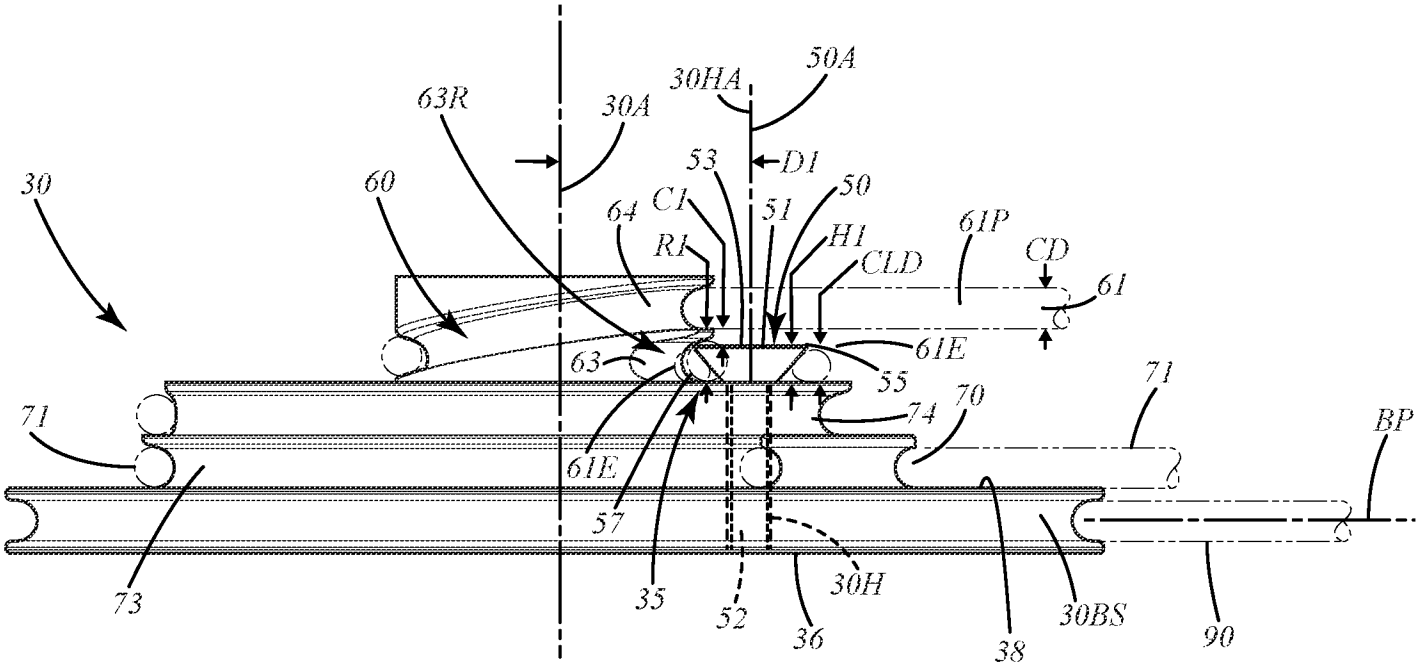
FIG. 4 is a side view of the cam with the fastener anchor.

With reference to FIGS. 2-4, the first power cable track 60 optionally can be in the form of a helical groove or track that wraps around the cam 30 and generally around the axis 30A and axle 31A, further optionally more than one time, when the bow is in an undrawn state. An example of a helical groove is described in U.S. Pat. No. 9,354,015 to Yehle, issued May 31, 2016, which is hereby incorporated in its entirety by reference. Of course, the helical power cable tracks as shown can be replaced with non-helical cable tracks, for example volute, eccentric and/or rounded tracks that are singular and lay in a single plane, which is optionally parallel to the bowstring plane BP or some other plane. In this alternative construction the power cable can be oriented so that it wraps onto itself upon draw, forming two or more layers of power cable, laying one on the other, in a plane perpendicular to the axle. Thus, the power cable can pile upon itself radially, away from the axis of rotation as the bow is drawn. The cable can thus layer upon or over itself as it extends around the axis.

Figure 5:
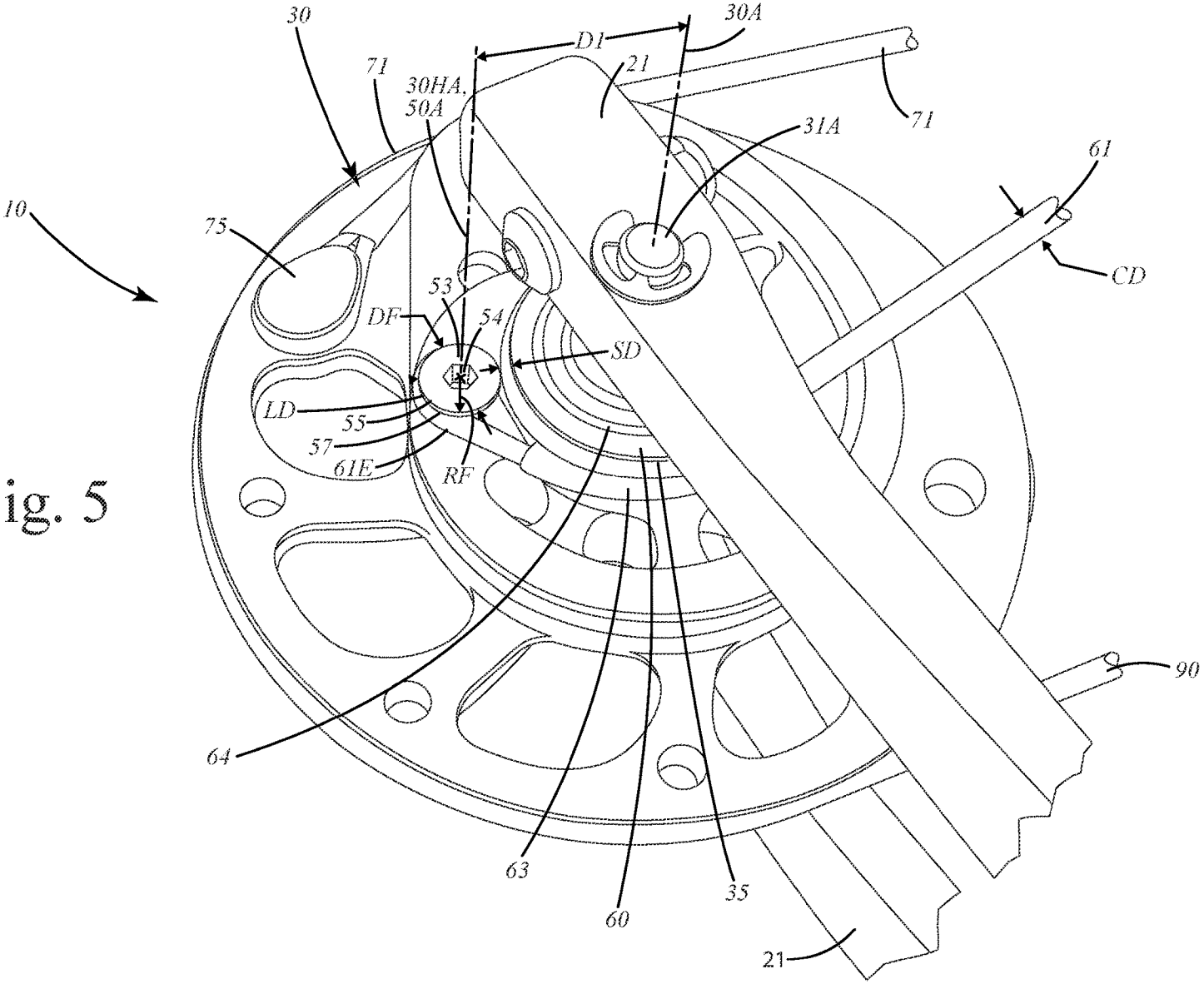
FIG. 5 is a perspective view of the cam in an undrawn state.
Figure 6:
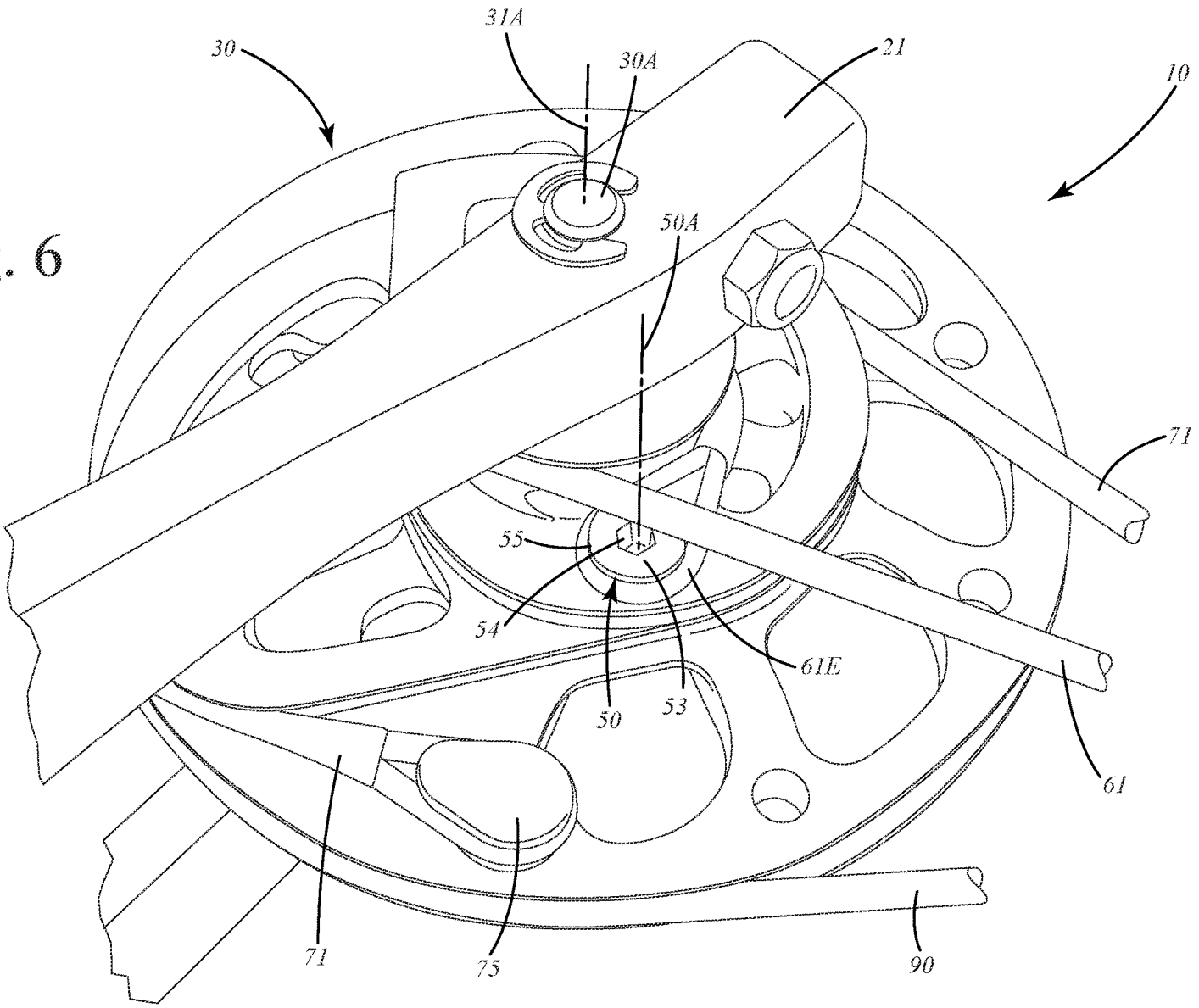
FIG. 6 is a perspective view of the cam in a drawn state, with the power cable clearing and having moved over an outer surface of the fastener anchor.

As shown in comparing FIGS. 4, 5 and 6, which illustrate the archery 10 bow in the undrawn (FIG. 5) and drawn states (FIGS. 4 and 6), the first power cable track 60 can be configured to let out the first power cable 61 when the bowstring is drawn, and the second power cable track 70 can be configured to take up the second power cable 71 when the bowstring is drawn. This first power cable track 60 is disposed above the second power cable track 70 and the bowstring track 30BS, and above the bowstring plane BP as shown in FIG. 4, which shows the cam 30 in an upside down condition as compared to when that cam is actually mounted on the archery bow 10. That being said, when mounted on the archery bow, the first power cable track is disposed below the second power cable track, below the bowstring track, and below the bowstring plane BP.

The second power cable track 70 can include a lower level 63 that is adjacent the first bowstring track 30BS. This second bowstring track optionally can include a second level 64 that takes up a portion of the power cable 71 as the bow is drawn. The second power cable track, which again can be a take up track, can be configured so that the second power cable 71 is disposed adjacent and moves outward or along the second landing surface 38, which can be adjacent the bowstring track 30BS. Optionally, the second power cable track 70 can be associated with or aligned with a second power cable anchor 75. The second power cable anchor 75 can be machined into the cam 30. Accordingly, it can be integrally and monolithically formed with the cam 30 and optionally the portion of the cam forming the bowstring track 30BS. Of course, desired, the fastener anchor 50 can be substituted for the integral anchor 75 depending on the application. The second power cable 71 can include in and loop 72 that fits over and engages the anchor 75 secure the second power cable 71 to the cam 30.

The first power cable track 60, which optionally can be in the form of a let out power cable track, can include a first level 63 and a second level 64, particularly where the track is of a helical configuration, wrapping around the axis 30A. The second or upper level 64 can be disposed above the first or lower level 63 of the power cable track 60. The upper level 64 of the track can be disposed farther away from the bowstring track 30BS than the lower or first level 63. Of course, these levels can be connected where the power cable track 60 is of the helical configuration. The upper level 64 can be separated from the lower level via a track rim 65 that is disposed between the two levels.

The cam 30 can be constructed so that the cam includes a landing surface 35 disposed adjacent and optionally surrounds at least a portion of the first power cable track 60. The lower level 63 of that power cable track can be immediately adjacent the landing surface 35. Optionally, that landing surface as shown can be planar, but of course in other applications, it can be rounded or contoured. The landing surface 35 also can be disposed between the first power cable track 60 and the second power cable track 70.

With reference to FIG. 4, the first cam 30 can define a first hole 30H that can define a first hole axis 30HA. The first hole 30H can extend from the landing surface 35 to an opposing surface 36 of the cam 30. The hole 30H can extend through the portion of the cam 30 that corresponds to the different portions of the bowstring track 30BS and the take up track 70. This hole 30H can optionally be threaded. The hole 30H also can be configured so that the first hole axis 30HA can be disposed a first distance D1 from the first axis 30A. The first hole 30H can be configured to receive the fastener anchor, also referred to as the fastener 50, which includes a head 51 and a shaft 52. The head can include an outer surface 53. The outer surface optionally can be planar as shown or can be of other configurations. The outer surface 53 can extend to an outer edge 55 of the head and/or fastener. The fastener head and generally the outer surface 53 can define a diameter DF. The fastener head and the outer surface also can define a first radius RF extending from the first fastener axis 50A to the first outer edge 55 of the first head 51.

The outer surface 53 and/or the head 51 can define a drive feature 54 which as shown can be hexagonal drive feature. Of course other types of drive feature such as hexalobular holes, Phillips head or flathead screwdriver holes, square drives, triangular drives or other features can be defined in the outer surface 53. Further although not shown, the drive feature can be in the form of lands or other projections or recesses defined by the outer surface 53 around an outer edge 55 of the head 51. The drive feature 54 can be engaged with a tool to rotate the fastener 50 about a fastener axis 50A. That fastener axis 50A can be coincident with and can correspond to the hole axis 30HA when the fastener 50 is installed in the hole 30H.

As shown in FIG. 4, the fastener includes a shaft 52, which can be threaded and can be installed in the hole 30H defined by the cam 30. Optionally in some applications, the shaft and hole can be smooth cylindrical mated part, which can be friction fit relative, glued, or otherwise secured to one another. Although not shown, the fastener 50 can include a secondary fastener (not shown) that screws into the shaft engages the cam to secure the fastener 50 in place relative to the landing surface 35.

As shown in FIGS. 2-4, the fastener 50 can include a tapered portion, optionally a frustoconical portion, 56 extending from the outer surface 53 toward the shaft 52. This tapered portion can extend from the first outer edge 55 downward toward and in some cases transition to the shaft 52. The shaft 52 can be installed in the hole 30H so that the tapered portion 56 extends away from the landing surface 35. Due to the tapered and optionally frustoconical shape of the head 51, a cable capture void 57 is formed between the outer surface 53 and the landing surface 35, both of which optionally can be planar. This cable capture void 57 can be configured to receive a portion of the first power cable 61.

The first power cable 61 can engage the cam 30 as shown in FIG. 5. There, the power cable 61 is shown engaging the first cam 30, wrapping around the power cable track 60, and extending into the lower level 63 and the upper level 64 of that power cable track. Where it is in the lower level 63, the power cable 61 can optionally and at least partially engage the landing surface 35 of the cam 30. The power cable 61 can include a cable diameter CD. This cable diameter can be optionally less than 0.150 inches, less than 0.125 inches, less than 0.100 inches, between 0.050 inches and 0.150 inches, inclusive, between 0.100 inches and 0.150 inches, inclusive, between 0.050 inches and 0.100 inches, or about 0.125 inches.

The power cable 61 can include a first end loop 61B. This first end loop 61B can include a cable loop diameter CLD. This cable loop diameter CLD can be approximately half, or slightly more than half, of the cable diameter CD values as mentioned above. This can be a result of the cable loop being constructed from half of the material of the elongated portion 61P of the power cable 61, which is looped back upon itself. This end loop 61B can include a first loop maximum dimension LD when the loop is placed on the around the fastener 50. This loop maximum dimension LD can be taken on the innermost portions of the loop. This loop maximum dimension LD can be less than the head diameter DF. In this configuration, when the loop is installed on the head 51 of the fastener, the loop can be prevented from slipping off our sliding past the outer edge 55 of the head 51.

With reference to FIGS. 3 and 5, the first power cable 61 can be joined with the first cam 30 via the fastener anchor 50. The first power cable end loop 61E can be disposed and optionally trapped within the cable capture void 57. The first end loop 61E can be disposed around the frustoconical portion 56, and within the first cable capture void 57, generally between the outer surface 55 and the landing surface 35. The first power cable 61 can extend away from the fastener anchor 50 until the first power cable 61 engages the power cable track 60.

The first power cable 61 as shown in FIGS. 3 and 4 can extend to the power cable let out track 60 and in particular the lower level 63 of that track. The first power cable 61 can first contact the first power cable let out groove 60 at a first tangent location 66 which may or may not be perfectly tangent to the surface of the power cable track 60. The first tangent location 66 can be disposed a first tangent distance TD from the first fastener axis 50A and from the hole axis 30HA. This first tangent distance TD can be less than the first distance D1 from the first fastener axis 50A to the axis of rotation 31A of the cam 30. In other cases, the first tangent distance TD can be equal to or greater than the first distance D1. Optionally, the first tangent distance and the first distance can be defined in a ratio, optionally without ratio being less than 1:1.

With further reference to FIG. 4, the fastener 50 can be installed relative to the landing surface 35 such that the first cable capture void 57 includes a height H1 between the outer surface 53 and the landing surface 35. This height H1 can be configured so as to allow the loop end 61E of the cable 61 to fit within the cable capture void 57. This first height H1 optionally can be less than the cable diameter CD of the cable. This first height H1, however, can be greater than the end loop diameter CLD which wraps around the portion of the head under the upper surface 53. Of course, in some applications, the first height H1 can be greater than the first cable diameter CD. As further shown in FIG. 4, the loop end 61E can project into the lower level 63 of the track 60. Where the loop and 61E extends into that lower level 63, that lower level of the track 63 can include a smaller radius 63R than a remainder of the track that accommodates the larger cable diameter CD. This is again because the loop end 61E can have a smaller cable loop diameter CLD than the cable diameter CD, for example, at the elongated portion 61P of the cable, distal from the fastener and the loop end 61E.

As shown in FIGS. 3-4, the fastener anchor 50 can be installed in the cam 30, with the fastener head 51 projecting upward and above the landing surface 35. As mentioned above, the head can have tapered and optionally frustoconical portion 56 that extends downward toward the landing surface 35. Optionally, although not shown, this frustoconical portion 56 can be replaced with a cylindrical portion with a shoulder near the outer surface 53, to form a T-shaped post, which would appear as a T shape in FIG. 4. Further optionally, the fastener head 51 can be formed in the shape of a mini pulley or cam with a track around its outer perimeter under the outer surface 53 and outer edge 55. This track (not shown) can be configured to accommodate the cable loop end 61E and its associated diameter CLD.

The fastener anchor 50 can be installed in the landing surface 35 such that the outer surface 53 of the fastener 50 is disposed adjacent the power cable track 60. Optionally, the fastener as mentioned can be can extend a first height H1 above the landing surface 35. The rim 65 of the cable track 60 can extend outward and toward and/or adjacent the fastener and optionally the outer edge 55 thereof. The rim 65 can be disposed at a distance R1 away from the landing surface 35. Optionally, the rim 65 can be disposed above the outer surface and/or head of the fastener. The distance R1 can be greater than the height H1. This can allow the cable 61 to let out over and above and generally move above and over the fastener 50 and the upper surface 53 thereof as described below.

The fastener anchor 50 can be installed in the landing surface 35 such that the outer surface 53 of the fastener extends away from the hole axis and fastener axis, toward the power cable track 60 and/or the rim 65. Due to its shape and size, the fastener can be placed such that the first outer edge 55 of the head 51 is separated from the first power cable let out track 60, and optionally the lower part 63 of the track and/or the rim 65, of the track by a first separation distance SD. This separation distance SD optionally can be less than 0.250 inches, less than 0.200 inches, less than 0.175 inches, less than 0.150 inches, less than 0.100 inches, less than 0.050 inches, less than 0.010 inches, zero, or other distances. For example, the separation distance can be less than the first radius RF of the fastener head 51 of the fastener 50, or even less than half of the first radius RF. In some cases, the separation distance SD and the radius RF can be defined in a ratio of the separation distance SD to the radius RF, with a ratio being optionally less than 1:1, less than 1:1.5, less than 1:2, less than 1:3, less than 1:4 or less than 1:5. This ratio can be selected based on the landing surface and a radius of the track 60, or other parameters to allow the cable to properly anchor to the cam.

The separation distance also can be selected so that the power cable 60, in particular the loop end 61E, cannot be removed from the first head 51 or the fastener 50 through the separation distance between the outer edge 55 and the power cable track 60 and/or its rim 65. In this manner, the loop can be held securely and/or trapped within the capture void 57. The separation distance also can have other relationships to other measurements of the cam components. For example, the separation distance SD can be less than the tangent distance TD. As another example, the height H1 of the fastener, in particular the outer surface from the landing surface, can be greater than the separation distance SD between the outer edge and the power cable track 60. The cable diameter CD and/or the loop and diameter CLD can be greater than the separation distance SD between the outer edge and the power cable track 60.

The embodiments of the cams 30 and 40, and the archery bow 10 in general with the fastener anchor 50 described herein, allow the power cables to be anchored and secured immediately adjacent a power cable track of the cam, and in a much closer proximity to the cable track then conventional, machined anchors. In some cases, the power cable 60, and even the portions of the end loop 61E can lay in both the capture void 57 under the head 51 of the fastener 50, as well as simultaneously lay in a portion of the power cable track 60, for example the portion of the track 63 adjacent the fastener. Optionally, due to the separation distance SD being minuscule between the outer edge 55 and the power cable track 60, the power cable and the loop end can be securely trapped by the head of the fastener.

Further, the fastener 50 can be well suited for helical type let out grooves and other power cable tracks. For example, as shown in FIGS. 4 and 5, when the archery bow 10 is drawn, the cable 61 can be let out of the power cable track 60. As this cable is let out of that power cable track 60, and in particular the upper level 64 of the track, the power cable, and in particular, an elongated portion 61P exiting the track, can swing outward and over the fastener 50, moving over the upper surface 53 of the fastener 51. As shown in FIG. 4, the portion 61P of the cable 61 can move over and above the outer surface 53 of the fastener 50 at a clearance distance C1. This clearance distance C1 can be sufficient so that the fastener 50 anchoring the power cable 61 to the cam does not interfere with the movement of the power cable portion 61P above and over the outer surface 53 of the fastener 50.

Optionally, as the cam 30 rotates from the undrawn state in FIG. 5 to the drawn state in FIGS. 4 and 6, the power cable portion 61P can begin to move outward, away from the axis of rotation 30A and toward the fastener axis 50A. In so doing, the power cable 61 and its portion 61P can move over the outer edge 55 of the head and toward the fastener 50A, toward the far side of the outer edge 55, away from the axis of rotation 30. In some cases, the cable portion 61P can be moved such that it is over the head, above the upper surface and in some cases the drive feature 54 of the fastener 50. Of course, when the bow is shot, the power cable 61 and its portion 61P move over and clear the outer surface and the fastener in an opposite direction so the power cable re-enters the power cable track 60.

A method of using the archery bow 10 of the current embodiments will now be described. The method can include providing the riser 23 joined with the first limb 21 and a second limb 22, placing the shaft 52 of the fastener 50 through a loop, for example an end loop of a power cable so that the loop is adjacent the head 51 of the fastener 50. The fastener can be installed relative to the cam, for example, by installing the shaft of the fastener 50 into the hole 30H defined by the cam. As mentioned above the hole can be defined by the landing surface 35 of the cam. The cam can include the power cable track 60. The power cable, and more particularly, the end loops of the power cable can be trapped in the cable capture void 57 between the head 51 in the landing surface 35 of the cam. The elongated portion 61P of the power cable 61, can be placed in the power cable track 60. Optionally, when the fastener is joined with the cam, a separation distance SD can be established between the head and the power cable track.

Where the power cable track optionally is a helical track having an upper cable track and a lower cable track, the power cable can be wrapped around the helical track from the lower level of the track to the upper level of the track. With the fastener of the current embodiments, when the bow is drawn, the power cable can move over and clear the head of the fastener, even though the head of the fastener is immediately adjacent a portion of the power cable track.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a power cable let out track and a power cable take-up track, the first cam including a first planar landing surface disposed adjacent the power cable let out track, the first cam defining a first hole having a first hole axis, the first hole axis being disposed a first distance from the first axis;

a first fastener including a first head and a first shaft, the first head having a planar outer surface defining a drive feature and a first tapered portion extending from the first planar outer surface toward the first shaft, the first shaft being installed in the first hole so that the first tapered portion extends away from the first planar landing surface and so that a first cable capture void is formed between the first planar outer surface and the first planar landing surface, the first fastener having a first fastener axis that is aligned with the first hole axis, the first head having a first radius extending from the first fastener axis to a first outer edge of the first head, the first planar outer surface extending away from the first hole axis and first fastener axis toward the first axis and toward the first power cable let out track such that the first outer edge of the first head is separated from the first power cable let out track by a first separation distance, the first separation distance and the first radius being defined in a ratio of the first separation distance to the first radius, the ratio being less than 1:1;

a second cam rotatably joined with the second limb for rotation about a second axis;

a bowstring engaging the first cam and the second cam, and configured to be wound and unwound therefrom; and a first power cable engaging the first cam and including a first end loop and a first cable diameter, the first end loop disposed around the first tapered portion and within the first cable capture void between the first planar outer surface and the first planar landing surface, the first power cable extending away from the first fastener until the first power cable engages the first power cable let out track.

2. The archery bow of claim 1, wherein the first power cable cannot be removed from the first head through the first separation distance between the first outer edge of the first head and the first power cable let out track.

3. The archery bow of claim 1, wherein the first loop defines a first loop maximum dimension, wherein the first head includes a first head diameter, wherein the first loop maximum dimension is less than the first head diameter.

4. The archery bow of claim 1, wherein the first power cable first contacts the first power cable let out groove at a first tangent location, wherein the first tangent location is disposed a first tangent distance from the first fastener axis, wherein the first tangent distance is less than the first distance but greater than the first separation distance.

5. The archery bow of claim 4, wherein the first tangent distance and the first distance are defined in a ratio of the first tangent distance to the first distance, with the ratio being less than 1:1.

6. The archery bow of claim 1, wherein the first cable diameter is greater than the first separation distance between the first outer edge and the first power cable let out track.

7. The archery bow of claim 1, wherein the first cable capture void includes a first height between the first planar outer surface and the first planar landing surface, wherein the first height is less than the first cable diameter.

8. The archery bow of claim 7, wherein the first height is greater than the first separation distance between the first outer edge and the first power cable track.

9. The archery bow of claim 8, wherein the first cable diameter is greater than the first separation distance between the first outer edge and the first power cable track.

10. The archery bow of claim 1 comprising:

wherein the first cable let out track is a helical track having an upper cable let out track, wherein the first power cable moves over and clears the first planar outer surface when the archery bow is drawn.

11. The archery bow of claim 1, comprising:

a second fastener including a second head and a second shaft, the second head having a planar upper surface defining a drive feature and a second tapered portion extending from the first planar outer surface to the first shaft, the first shaft being installed in the first hole so that the first tapered portion extends away from the first planar landing surface and so that a first cable capture void is formed between the first planar outer surface and the second planar landing surface, the second fastener having a second fastener axis that is aligned with the second hole axis, the second head having a second radius extending from the second fastener axis to a second outer edge of the second head, the second planar outer surface extending away from the second hole axis and second fastener axis toward the second axis and toward the second power cable let out track such that the second outer edge of the second head is separated from the second power cable let out track by a second separation distance, the second separation distance and the second radius being defined in a ratio of the second separation distance to the second radius, the ratio being less than 1:1; and a second power cable engaging the second cam and including a second end loop and a second cable diameter, the second end loop disposed around the second tapered portion and within the second cable capture void between the second planar outer surface and the second planar landing surface, the second power cable extending away from the second fastener until the second power cable engages the second power cable let out track.

12. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis and being threaded, the first hole axis being disposed a first distance from the first axis;

a first fastener including a first head and a first shaft that is threaded, the first head having a first outer surface defining a drive feature, the first shaft being threadably installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom; and a first power cable engaging the first cam and including a first cable diameter, the first power cable disposed within the first cable capture void, the first power cable extending away from the first fastener until the first power cable engages the first power cable track in which the first power cable is further disposed.

13. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis, the first hole axis being disposed a first distance from the first axis;

a first fastener including a first head and a first shaft, the first head having a first outer surface defining a drive feature, the first shaft being installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom;

a first power cable engaging the first cam and including a first cable diameter, the first power cable disposed within the first cable capture void, the first power cable extending away from the first fastener until the first power cable engages the first power cable track in which the first power cable is further disposed; and wherein the first separation distance is less than the first radius.

14. The archery bow of claim 13, wherein the first separation distance is less than on half the first radius.

15. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis, the first hole axis being disposed a first distance from the first axis;

a first fastener including a first head and a first shaft, the first head having a first outer surface defining a drive feature, the first shaft being installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom;

a first power cable engaging the first cam and including a first cable diameter, the first power cable disposed within the first cable capture void, the first power cable extending away from the first fastener until the first power cable engages the first power cable track in which the first power cable is further disposed; and wherein the first separation distance is less than the first cable diameter.

16. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis, the first hole axis being disposed a first distance from the first axis;

a first fastener including a first head and a first shaft, the first head having a first outer surface defining a drive feature, the first shaft being installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom;

a first power cable engaging the first cam and including a first cable diameter, the first power cable disposed within the first cable capture void, the first power cable extending away from the first fastener until the first power cable engages the first power cable track in which the first power cable is further disposed; and wherein the first cable capture void includes a first height between the first outer surface and a first planar landing surface of the first cam in which the first hole is formed, wherein the first height is less than the first cable diameter.

17. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis, the first hole axis being disposed a first distance from the first axis;

a first fastener including a first head and a first shaft, the first head having a first outer surface defining a drive feature, the first shaft being installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom;

a first power cable engaging the first cam and including a first cable diameter, the first power cable disposed within the first cable capture void, the first power cable extending away from the first fastener until the first power cable engages the first power cable track in which the first power cable is further disposed; and wherein the first height is greater than the first separation distance between the first outer edge and the first track, wherein the first cable diameter is greater than the first separation distance between the first outer edge and the first track.

18. A method of using an archery bow, the method comprising:

providing a riser joined with a first limb and a second limb;

placing a shaft of a fastener through a loop of a power cable so that the loop is adjacent a head of the fastener;

installing the shaft of the fastener into a hole defined by a landing surface of a cam including a power cable track so that the power cable is trapped in a cable capture void between the head and the landing surface; and placing an elongated portion of the power cable in the power cable track, wherein the fastener is spaced so close to the power cable track after the installing step that the power cable cannot be removed from the fastener between the fastener and the power cable track.

19. The method of claim 18 comprising:

establishing a separation distance between the head and the power cable track, wherein the fastener includes a radius between a fastener axis and an outer edge of the head, wherein the separation distance and the radius are defined in a ratio of the separation distance to the radius, the ratio being less than 1:1.

20. The method of claim 19, wherein the power cable track is a helical track having an upper cable track, wherein the power cable moves over and clears the head when the archery bow is drawn.

21. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis, the first hole axis being disposed a first distance from the first axis;

a first fastener including a first head and a first shaft, the first head having a first outer surface, the first shaft being installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom; and a first power cable engaging the first cam and including a first cable diameter, the first power cable disposed within the first cable capture void, the first power cable extending away from the first fastener until the first power cable engages the first power cable track in which the first power cable is further disposed; and wherein the first power cable cannot be removed from the first head through the first separation distance between the first outer edge of the first head and the first power cable track.

22. An archery bow comprising:

a riser;

a first limb joined with the riser on a first side of a medial plane;

a second limb joined with the riser on a second side of the medial plane, opposite the first limb;

a first cam rotatably joined with the first limb for rotation about a first axis, the first cam including a first power cable track, the first cam defining a first hole having a first hole axis, the first hole axis being disposed a first distance from the first axis;

a first fastener including a first head and a first shaft, the first head having a first outer surface, the first shaft being installed in the first hole so that a first cable capture void is formed below the outer surface, the first fastener having a first fastener axis, the first head having a first radius extending from the first fastener axis to a first outer edge of the first head, the first outer surface extending away from the first fastener axis toward the first axis and toward the first power cable track such that the first outer edge of the first head is separated from the first power cable track by a first separation distance;

a second cam rotatably joined with the second limb for rotation about a second axis;

a bowstring engaging the first cam and the second cam, and configured to be wound and unwound therefrom; and a first power cable engaging the first cam and including a first cable diameter, the first power cable disposed within the first cable capture void, the first power cable extending away from the first fastener until the first power cable engages the first power cable track in which the first power cable is further disposed, wherein the first loop defines a first loop maximum dimension, wherein the first head includes a first head diameter, wherein the first loop maximum dimension is less that the first head diameter.

* * * * *